US005388715A

United States Patent [19]

Schwindt

[11] Patent Number: 5,388,715

[45] Date of Patent: Feb. 14, 1995

[54] SPILL PROOF PAINT LID

[76] Inventor: Larry Schwindt, 154 Snyder Avenue North, Elmira, Ontario, Canada, N3B 2B7

[21] Appl. No.: 188,690

[22] Filed: Jan. 31, 1994

[51] Int. Cl.[6] ..... B65D 43/20

[52] U.S. Cl. ..... 220/354; 220/229; 220/733; 222/570

[58] Field of Search ..... 220/229, 354, 700, 701, 220/733; 222/566, 570, 575

[56] References Cited

U.S. PATENT DOCUMENTS

| | | | |
|---|---|---|---|
| 2,788,614 | 3/1957 | Giusto | 222/570 |
| 4,865,233 | 9/1989 | Kain | 222/570 |
| 4,926,390 | 5/1990 | Murzsa | 366/249 |
| 4,949,884 | 8/1990 | Dahl | 222/570 |
| 5,111,946 | 5/1992 | Glanz | 215/247 |

*Primary Examiner*—Gary E. Elkins
*Assistant Examiner*—Nova Stucker

[57] ABSTRACT

A spill proof paint lid with pouring and stirring capabilities comprising, in combination, a central circular plate with a periphery, the periphery having a downwardly extending exterior extent and an interior ring. The interior ring is formed as a locking lip positionable in the trough of the paint can. A pouring spout extends upwardly from the circular plate adjacent to the interior ring. The spout has a rectangular cross sectional configuration with its axis extending radially outwardly from the center of the plate at an angle. The circular plate and spout are integrally formed of plastic. A stirring slot is formed in the circular plate essentially equally distant between the center of the plate and the exterior extent diametrically opposed from the spout.

1 Claim, 2 Drawing Sheets

SPILL PROOF PAINT LID

BACKGROUND OF THE INVENTION

1. Field of the Invention

The present invention relates to a spill proof paint lid with pouring and stirring openings and more particularly pertains to a paint can lid which has a spout for pouring paint and a slot for stirring the paint.

2. Description of the Prior Art

The use of functional paint can lids is known in the prior art. More specifically, functioned paint can lids heretofore devised and utilized for the purpose of pouring and/or stirring are known to consist basically of familiar, expected and obvious structural configurations, notwithstanding the myriad of designs encompassed by the crowded prior art which have been developed for the fulfillment of countless objectives and requirements.

Prior art disclosed, for example, U.S. Pat. Nos. 4,312,459 to Leach; 5,165,562 to Raney; 3,941,275 to Simmons which disclose paint can periphery and associated lips on lids for the coupling therebetween.

U.S. Pat. No. 4,949,884 to Doll and 5,031,804 to Conrad disclose paint can lids with integrally formed spouts.

Lastly, U.S. Pat. No. Des. 326,819 to Border discloses a paint can with a spout and stirring stick.

In this respect, the spill proof paint lid according to the present invention substantially departs from the conventional concepts and designs of the prior art, and in so doing provides an apparatus primarily developed for the purpose of facilitating the stirring and pouring of paint.

Therefore, it can be appreciated that there exists a continuing need for new and improved spill proof paint lid which can be utilized to facilitate the stirring and the pouring of paint. In this regard, the present invention substantially fulfills this need.

SUMMARY OF THE INVENTION

In view of the foregoing disadvantages inherent in the known types of functional paint can lids now present in the prior art, the present invention provides an improved spill proof paint lid. As such, the general purpose of the present invention, which will be described subsequently in greater detail, is to provide a new and improved spill proof paint lid apparatus and method which has all the advantages of the prior art and none of the disadvantages.

To attain this, the present invention essentially comprises a spill proof paint lid with pouring and stirring capabilities comprising, in combination, a central circular plate with a periphery, the periphery having a downwardly extending exterior extent and interior ring. The interior ring is formed as a locking lip positionable in the trough of a paint can. The exterior extent is positionable in contact with the exterior surface of the paint can. A pouring spout extends upwardly from the circular plate adjacent to the interior ring. The spout has a rectangular cross sectional configuration with its axis extending radially outwardly from the center of the plate at an angle of between about 20 and 40 degrees from the vertical. The circular plate and spout are integrally formed of a flexible high density polyethylene. A stirring slot is formed in the circular plate essentially equally distant between the center of the plate and the exterior extent diametrically opposed from the spout.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved spill proof paint lid with pouring and stirring capabilities which has all the advantages of the prior art functional paint can lids and none of the disadvantages.

It is another object of the present invention to provide a new and improved spill proof paint lid with pouring and stirring capabilities which may be easily and efficiently manufactured and marketed.

It is a further object of the present invention to provide a new and improved spill proof paint lid with pouring and stirring capabilities which is of a durable and reliable construction.

An even further object of the present invention is to provide a new and improved spill proof paint lid with pouring and stirring capabilities which is susceptible of a low cost of manufacture with regard to both materials and labor, and which accordingly is then susceptible of low prices of sale to the consuming public, thereby making such spill proof paint lid with pouring and stirring capabilities economically available to the buying public.

Still yet another object of the present invention is to provide a new and improved spill proof paint lid with pouring and stirring capabilities which provides in the apparatuses and methods of the prior art some of the advantages thereof, while simultaneously overcoming some of the disadvantages normally associated therewith.

Still another object of the present invention is to stir paint in a can through the lid.

Yet another object of the present invention is to pour paint from a can through a spout in the lid.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
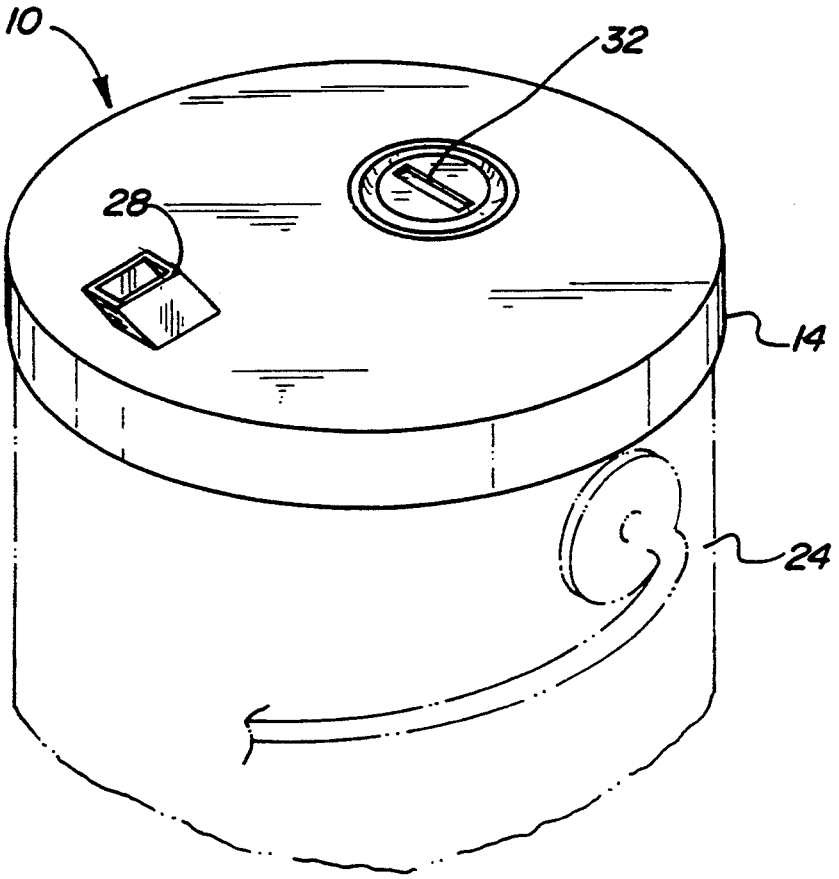
FIG. 1 is a perspective illustration of a spill proof paint lid with pouring and stirring openings constructed in accordance with the principles of the present invention.
Figure 2:
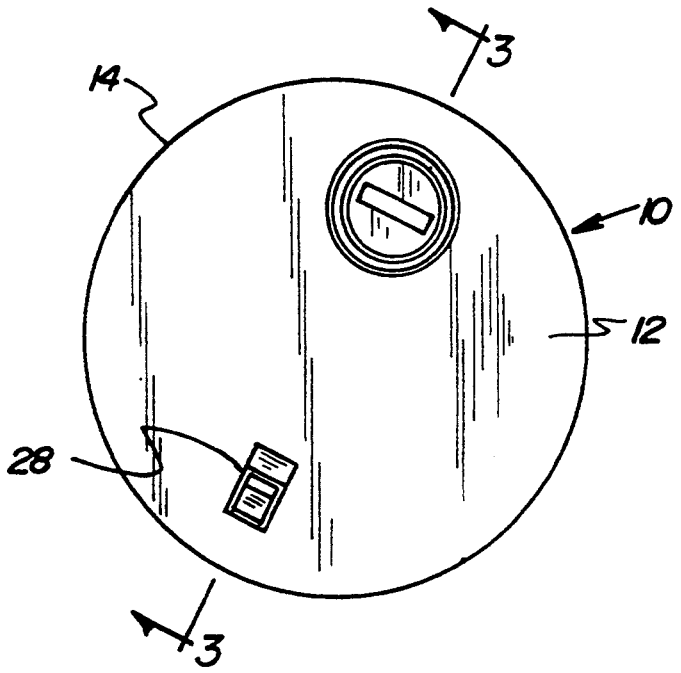
FIG. 2 is a top plan view of the spill proof paint lid shown in FIG. 1.
Figure 3:
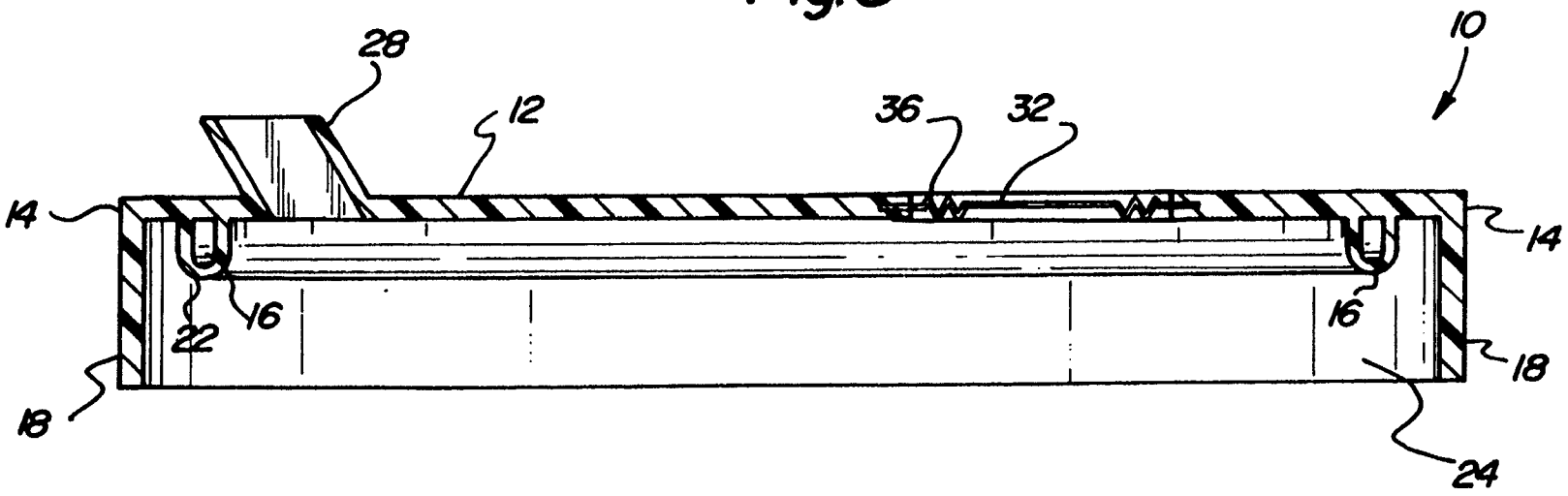
FIG. 3 is a cross sectional view of the device taken along line 3—3 of FIG. 2.

With reference now to the drawings, and in particular to FIG. 1 thereof, a new and improved spill proof paint lid with pouring and stirring capabilities embodying the principles and concepts of the present invention and generally designated by the reference numeral 10 will be described.

More specifically, it will be noted that the spill proof paint lid 10 is provided with pouring and stirring capabilities for increased efficiency and convenience. The lid 10 comprises a central circular plate 12 with a periphery 14. The periphery has a downwardly extending interior ring 16 and exterior extent 18. The interior ring 16 is formed as a locking lip and is preferably more rigid than the remainder of the circular plate 12. The interior ring 16 is positionable within the trough 22 of a paint can 24. The exterior extent 18 is positionable over the exterior surface of the paint can periphery. It is adapted to extend downwardly about 1½ to 2 inches. For a standard paint can with a diameter of about 7 inches, this is between about 20 percent to about 30 percent of the diameter of the circular plate 12.

A pouring spout 28 is provided to extend upwardly from the circular plate adjacent to and radially interiorly of the interior ring 16. The spout 28 has a rectangular cross sectional configuration with its axis extending radially outwardly from the center of the plate. The axis is at an angle of between 20 and 40 degrees from the vertical, preferably about 30 degrees.

A stirring slot 32 is formed in the circular plate essentially equally distant between the center of the plate and the exterior extent 18. The slot is located, in the preferred embodiment, diametrically opposed from the spout 28. The slot edges being normally urged into contact with each other through the resilience of the material at the center of the slot for its closure. The slot edges, however, are separable by the movement of a stir stick into the slot 32.

The circular plate 12 is flexible. It is of a thin sheet of material throughout its entire extent. Lid 10 may be, however, thickened in the spout 28, the interior ring 16 and the region 36 around the slot 32 so as to provide a lesser degree of flexibility and a greater degree of rigidity in such areas for superior performance. The circular plate 12 and spout 28 are integrally formed of a flexible plastic, preferably high density polyethylene.

The spill proof paint can lid of the present invention has been designed to simplify the clean-up chores and eliminate the problems associated with pouring paint from a can. It eliminates the need to clean the sealing groove of the can, which is time consuming, but imperative; and the spillover onto the side of the can that obscures label information. Other benefits to consumers include:

Controls the paint when pouring. Flow rate and stream precision are easily governed.

Prevents drying of the paint, while allowing effortless access.

Does not hinder stirring of paint, as an entry for a stir stick is provided.

Allows quick and simple clean-up. The spill proof paint can lid of the present invention is peeled off can and thrown away.

It is suitable for use with all types of paint; acrylics, lacquers, and enamels.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A spill proof paint lid with pouring and stirring capabilities comprising, in combination:

a central circular plate with a periphery, the periphery having a downwardly extending extent and a concentric interior ring, the exterior extent being longer than the interior ring, the interior ring is formed as a locking lip positionable in the trough of a paint can, the exterior extent being positionable in contact with the exterior surface of the paint can;

a pouring spout extending upwardly from the circular plate adjacent to the interior ring, the spout having a rectangular cross sectional configuration with its axis extending radially outwardly from the center of the plate at an angle of between about 20 and 40 degrees from the vertical, the circular plate and spout being integrally formed of a flexible high density polyethylene; and an elongated stirring slot formed in the circular plate essentially equally distant between the center of the plate and the periphery at a location diametrically opposed from the spout.

* * * * *